US005365953A

United States Patent [19]

Feughelman

[11] Patent Number: 5,365,953

[45] Date of Patent: Nov. 22, 1994

[54] HAIR SETTING APPARATUS

[75] Inventor: Max Feughelman, Ryde, Australia

[73] Assignee: Fibrous Keratin Pty Limited, Castle Hill, Australia

[21] Appl. No.: 781,209

[22] PCT Filed: Jun. 7, 1990

[86] PCT No.: PCT/AU90/00251

§ 371 Date: Feb. 4, 1992

§ 102(e) Date: Feb. 4, 1992

[87] PCT Pub. No.: WO90/14780

PCT Pub. Date: Dec. 13, 1990

[30] Foreign Application Priority Data

Jun. 7, 1989 [AU] Australia ..... PJ4625

[51] Int. Cl.[5] ..... A45D 4/18

[52] U.S. Cl. ..... 132/231; 132/229; 132/252

[58] Field of Search ..... 132/227, 228, 229, 231, 132/245, 251, 252, 269; 219/222, 225, 226

[56] References Cited

U.S. PATENT DOCUMENTS

| | | | |
|---|---|---|---|
| 3,572,350 | 3/1971 | Adams et al. | 132/252 |
| 4,258,731 | 3/1981 | Tsujimoto et al. | 219/222 |
| 4,259,566 | 3/1981 | Kobayashi | 219/222 |
| 4,602,143 | 7/1986 | Mack et al. | 219/225 |
| 4,627,452 | 12/1986 | Caruso | 132/229 |
| 4,740,669 | 4/1988 | Takimae | 219/225 |
| 4,910,832 | 3/1990 | Kakuya et al. | 219/222 |

FOREIGN PATENT DOCUMENTS

| | | |
|---|---|---|
| 514434 | 2/1981 | Australia . |
| 0244522 | 11/1987 | European Pat. Off. . |
| 1232707 | 1/1967 | Germany . |
| 2720961 | 11/1978 | Germany . |
| 333107 | 8/1930 | United Kingdom . |
| WO83/00606 | 3/1983 | WIPO . |

*Primary Examiner*—Gene Mancene
*Assistant Examiner*—Frank A. LaViola
*Attorney, Agent, or Firm*—Kilpatrick & Cody

[57] ABSTRACT

A permanent hair setting apparatus is disclosed wherein infrared radiation is used to heat the hair in conjunction with a permanent setting composition to a temperature of 100° C. Heating of the hair occurs by winding the hair on infrared generating formers. The apparatus allows for the attainment of permanent setting with a heating time of only 5–60 seconds. Relatively dilute solutions of permanent setting composition are required, which dispenses with the need to neutralize the hair after setting. The use of the apparatus thereby permits permanent setting of the hair to be completed within about 30 minutes.

14 Claims, 4 Drawing Sheets

HAIR SETTING APPARATUS

FIELD OF THE INVENTION

The present invention relates to apparatus for use in the permanent setting of hair and more particularly to an apparatus that uses infrared radiation as the source of energy to control the temperature at which setting occurs.

BACKGROUND ART

As used in specification, permanent setting of the hair refers to the process of chemically treating the hair whereby the breaking down and reformation of covalent bonds in the hair causes the structure of the hair to be altered. Permanent setting is used to create waves, curls and the like in the hair on a "permanent" basis.

A distinction may be made between the processes of permanent setting and that of cohesive setting in that in the latter case, the hair is merely heated in a wet state, without any chemical action, until the hair is substantially dry. A cohesive set whilst also able to produce wave or curled hair lacks permanency due to the fact that as soon as the cohesively set hair is wet, the curl or wave is lost. Such wetting as that caused by excessive ambient humidity or washing is sufficient to defeat a cohesive set.

By contrast, a permanent set is unaffected by the presence of water to the extent that even after washing, the hair will be maintained in its curled or waved state..

It is well known in the art that a permanent set may be achieved by the treatment of the hair using various compositions, typically aqueous thioglycollate solutions such as those based on ammonium thioglycollate, under neutral or alkaline condition. Typically, the hair to be set is wet with the thioglycollate solution and then wound onto curling or perming rods. The hair is then left for up to about thirty minutes after which time the hair is treated with a neutralizer solution, the curlers removed. and the so treated hair washed to remove substantially all of the chemicals used in the treatment. It is to be noted that the purpose of the neutralizer solution is to terminate the reaction of the thioglycollate with the hair.

Although the aforementioned process has been known for some time, it would appear that there have been relatively few changes made thereto, although it is to be noted that there have been numerous modifications proposed to the setting composition.

One of the disadvantages of the process is the time taken to effect setting and the attended discomfort the person whose hair is being set experiences in setting. To this end, the prior art has recognized that the rate of reaction of setting compositions on the hair may be increased by heating. Unfortunately, without very close control of the heating conditions, the effect of the application of heat on the process has been found to be generally too variable with the result that the quality of the setting obtained is usually unacceptable.

In PCT/EP82/00173 (WO83/00606) there is disclosed heat treatment apparatus for heating the human hair on the head which uses an infrared source to generate heat in the hair. This apparatus is disclosed as being useful in the permanent setting of the hair. However, it is to be noted that this apparatus generates and applies infrared radiation from a source external to the hair.

In other art such as Australian patent 514,434, there are disclosed infrared hair dryers. In this patent and the other art known to the present applicant, such apparatus utilise infrared radiation sources external to the hair generally in conjunction with blowers to dry the hair. Clearly the infrared sources in these apparatus are used merely as a source of heat, ambient air being drawn over the sources, heated and blown onto the hair.

U.S. Pat. No. 4,602,143 (Mack et al) discloses an apparatus for use in cohesive hair setting in which moistened hair is wound on a member in which there is disposed an infrared radiation source. By controlling the duration of action of the source, the extent of heating can be controlled to effect drying of the hair rapidly, whilst the cohesive set is formed.

The present inventor has recognized that there continues to exist a need for an apparatus and a method by which the hair may be set quickly, reliably, reproducibly and permanently, that is a set not lost in water or high humidities.

DISCLOSURE OF THE INVENTION

Accordingly, it is an object of the present invention to provide an apparatus and a method that is capable of effecting setting of the hair rapidly, reliably, reproducibly and permanently using infrared radiation to obtain rapid initiation, delivery and cessation of energy to the hair. The use of an infrared energy source is vital to the rapidity, reliability and reproducibility of the setting of the hair.

The present invention consists in a permanent hair setting apparatus comprising a hollow infrared radiation transparent or absorbent former adapted to have hair wound thereon, an infrared radiation source within said former, energizing means operatively connected to said source for activating the same, control means operatively connected to said energizing means for intermittently activating said source in a predetermined manner and means to cover the hair wound on the former to an extent sufficient to maintain the hair moist during the time in which said infrared radiation source is activated.

In another aspect, the present invention consists in an improvement to a method for the permanent setting of the hair in which the hair is treated with an effective amount of a composition capable of acting on the hair to cause it to be set whilst the hair is wound on a former, the rate of action of said composition increasing with increasing temperature, the improvement comprising heating the hair with infrared radiation from within the former for a time sufficient to effect the setting.

In a further aspect, the present invention consists in an apparatus for use in the permanent setting of hair, comprising a hollow infrared transparent or absorbent former adapted to have hair wound thereon, an infrared source within the former and means to cover the hair wound on the former to an extent sufficient to maintain the hair moist during the time in which said infrared radiation source is activated.

In a still further aspect, the present invention consists in a permanent hair setting composition which includes 1–4% w/v of thioglycollate.

The advantage of the present invention lies in the use of infrared radiation to heat the hair with the setting composition from within the former on which the hair is wound thereby minimising heat loss with the consequence that heating time is greatly reduced and the heat application to the hair is initiated and stopped within a time span of less than one second enabling the reaction rate of the composition on the hair to proceed in a controlled manner. Further, because of the elevated temperature at which the change in the hair occurs, less breakdown and hence less damage occurs in the hair. In a typical permanent wave process using the present invention, the breakdown of covalent bonds in the hair structure was shown to be less than one third that in a normal permanent setting procedure.

The present inventor notes that in the aforementioned U.S. Pat. No. 4,602,143 (Mack et al), there is no teaching whatsoever that moisture is to be retained in the hair, other than the water normally present in the hair, owing to the fact that this patent is directed towards cohesive setting, which setting requires the hair to be made moist, disposed about a hair winding portion and the hair heated by an infrared source within the hair winding portion for a time sufficient to substantially dry the hair. Thus, the apparatus disclosed therein also includes as an essential feature a temperature sensor adapted to sense the temperature within the hair winding portion and control it within a predetermined range. Clearly, at least one reason why this temperature sensor is required is to ensure that the infrared source will be deactivated once the hair is substantially dry or otherwise the hair would be heated to an excessive temperature. Mack, et al., also state that their aim is to obtain uniform heating of the hair and avoid overheating.

By contrast, the present invention requires sufficient water to be retained in the hair so that the reaction with the setting composition is able to proceed and to control the temperature of the hair to substantially a maximum of 100° C. Such a requirement is contrary to the teaching of the aforementioned U.S. patent.

The hollow former of the invention may be formed from a variety of materials known in the relevant art. One useful material to form an infrared transparent former is silica formed into a vitreous tube. Silica does, however, suffer from the disadvantage that it may be breakable in use, or may be perceived to be easily broken. An alternative to vitreous tube for an infrared absorbent former is metallic tube, wherein the metal is appropriately resistant to the hairsetting composition. A particularly useful metal is stainless steel 316, 0.5 mm thick.

The dimensions of the former may be varied between wide limits. Generally, however, the length will be about 8 cm which corresponds approximately with the length of prior art perming and curling rods.

Similarly, the width of the former may be varied over wide limits, though the width selected will be determined by the extent of curling or waving of the hair required. Thus, as the width of the former increases, the width of the curl will generally be increased. A useful width may be about 6 mm.

Preferably the former will be tubular although other cross sectional shapes are also contemplated by the invention; a non-limiting example being hexagonal.

In an embodiment where vitreous tube constitutes the former, in order to achieve satisfactory strength, the wall thickness may be of the order of 1 mm. However, given that in use, particularly in a hairdressing salon, a former may be potentially subjected to rough handling, a wire gauze or guard may be placed over the outside of the tube so that it overlaps at least one end of the tube. In this arrangement, the diameter of the wire selected to form the gauze or guard would be sufficient to ensure that it would not be broken or damaged in use.

The selection of the material from which the wire is formed is important in that it should be inert toward the setting composition used. Thus, if thioglycollate based compositions were used, the wire could be a molybdenum based stainless steel.

The infrared radiation source in a preferred embodiment comprises a hot wire, such as Kanthal., capable of being heated continuously up to a temperature of 1100° C. using a voltage in the range of about 4–30 volts. Such a fine wire source is capable of rapid attainment of temperature and loss of temperature on application and removal of voltage. Further, the high temperature results in an energy transfer being proportional to the fourth power of the absolute temperature of the wire. The heat transfer being from a low heat inertia source and the transfer itself being via infrared radiation results in the rapid response to the application and removal of heat.

A particularly preferred infrared radiation source comprises a spirally wound wire formed from Kanthal. Desirably the Kanthal is 23 gauge, circular section, having a resistivity of 1.58 ohms/foot. When Kanthal is used, 6 volts at about 5 amps will provide a temperature of about 850° C., although an effective temperature range is about 800°–1000° C.

It is most desirable that the infrared radiation source be capable of being readily removed from the former to allow it to be cleaned by rinsing with water to remove setting composition. As the infrared source is operatively connected by a pair of wires, preferably the infrared source will be capable of being readily plugged into the former and removed as required. Thus, when the infrared source is for example a tube, only the tube itself will require cleaning. The utility of such an arrangement extends further, in that in use, hair may be readily wound onto each former, with the respective infrared sources removed. Once the hair is wound on, the infrared sources could then be plugged into each former.

An alternative infrared source comprises a source of infrared radiation remote from the former and a means capable of transmitting the infrared radiation to within the former. In such an embodiment, the infrared source may be an infrared lamp, typically having a power output of about 1 kilowatt and the transmission means may be an optical fibre.

To ensure that adequate water is maintained on the hair whilst it is being set, a water impermeable member is placed over the hair wound on the former. The dimensions of the member are selected to ensure that all the hair being set is substantially covered.

Desirably, this member will also be infrared opaque, thereby ensuring that either none or at most a minimal amount of infrared radiation escapes from the environment immediate the hair and former. Particularly preferred is a member which is infrared reflective on its surface in contact with the hair. The advantage of this arrangement being that the temperature of the hair and composition will increase rapidly and more even heating will occur. A useful construction of the member might be a metal foil, in particular aluminium foil. Such material may be readily wrapped around the hair once it has been wound on the former. It is also to be noted that since this material contacts a setting composition, it needs to be substantially unreactive towards the composition. In the case of aluminium, where the composition contains thioglycollate, aluminium sulphide will rapidly form on the surface of the aluminium in contact therewith, and thereafter the surface will be unreactive towards the composition.

In addition to a water impermeable member, a water absorbent member may be disposed in a manner so as to substantially cover the hair wound on the former. This too will serve to maintain an adequate moisture content in the hair.

The transfer of heat from the surface of the former through the hair mass has been shown to be due to evaporation and condensation of water travelling radially outwards from the surface. As the water condenses, wicking ensures that water returns to the surface of the former. Once the heating has reached the outer surface of the hair mass, the evaporating water penetrates the water absorbing member which itself is wet with the setting composition. The result is that the hot water vapour condenses in the water absorbing member and wicking will return the water to the hair mass.

The means for activating the infrared source, recognizing the source will be electrically operated, may comprise any one of a wide range of switches known in the art.

In those embodiments where the infrared source is a hot wire, preferably operated at 6 to 12 volts, for safety and reasons of convenience, the voltage will be derived from a transformer operating from a mains voltage. Thus, a suitable switch would allow the low voltage to be switched on or off as required.

Most preferably the transformer will be of a suitable leakage reactance and saturated core type, so that if the mains voltage fluctuates by say 10% or electrical contact resistance to the infrared source varies, the transformer will maintain a constant current in the connected infrared sources. In this embodiment the sources are connected in parallel.

The present invention contemplates that the actual heating time of the hair will generally be about 30 to 60 seconds. To achieve such times, a control means is used to turn off the current to the infrared source after a predetermined time has elapsed. Such a control means will usually comprise a timer, generally electrically driven and well known in the relevant art, equipped with a means that cuts off current to the source after the selected time has elapsed.

In a particularly preferred embodiment, the control means and the means for activating the infrared source may be a single piece of apparatus comprising a timer equipped with a suitable switch.

When used in a hairdressing salon, generally the apparatus of the invention will comprise a plurality of infrared transparent hollow formers, infrared sources and water impermeable members. The advantage of this arrangement is that a substantial portion of the hair on a head may be set concurrently.

Preferably, sufficient formers, sources and members will be provided to enable one half of the hair of the head to be set concurrently. Usually, the numbers of former sources and members required will be about 30 per half head where the length of a former is about 8 cm and the diameter about 10 mm. Thus, advantageously in an embodiment where the infrared sources may be removed from the formers, following the setting of one half of the head, and whilst the formers are cooling, a second set of formers may be used to wind on the hair of the other side of the head. The infrared sources may then be conveniently plugged into the second set of formers allowing setting to proceed. Clearly in such embodiments, the control means and means for activating the infrared source would not have to be duplicated but naturally the power rating of the transformer selected to operate the infrared sources would have to be adequate.

In an embodiment in which a remote infrared lamp is used together with an optical fibre as the infrared source, a single infrared lamp may be used to provide infrared radiation for a plurality of optical fibre. Thus, in this embodiment, at least one optical fibre is used for each former.

Whilst it has been mentioned that the formers will become quite hot during hair setting, it will be recognized by those skilled in the art that merely allowing sufficient time to elapse after treatment will ensure that the formers can be safely removed from the hair.

The present inventor has found that perming compositions containing about 1–4% thioglycollate are operative when used with the inventive apparatus. This concentration range is substantially lower than that used in compositions for salon use, up to 11% thioglycollate and for home use, 5–8% thioglycollate.

Furthermore, whereas the prior art perming procedure required the use of a "neutralizer", typically hydrogen peroxide, the present invention does not require the use of a neutralizer. The hair need only be rinsed after the heat treatment.

The use of a lower thioglycollate concentration is important in that the hair will be less damaged during the perming procedure. Furthermore, as most salon operators do not wear gloves, the incidence of dermatitis would be substantially reduced.

From the foregoing, it will be evident that the present invention has one marked advantage over the prior art, when it is realised that the hair may be typically set within a few minutes as opposed to the prior art treatments which require 20 to 30 minutes at least.

A further advantage that flows from the invention is that since it is usual for a test portion of the hair to be set prior to the whole of the hair being set, in order to determine a suitable setting time, this test procedure may be accomplished in a relatively short time compared to prior art treatment. Therefore, the total time for setting is greatly reduced.

Additionally, the use of lower concentrations of thioglycollate leads to less damage to the hair and a reduced incidence of dermatitis in salon operators.

Hereinafter, by way of example only is described one embodiment of the invention in which:

Figure 4:
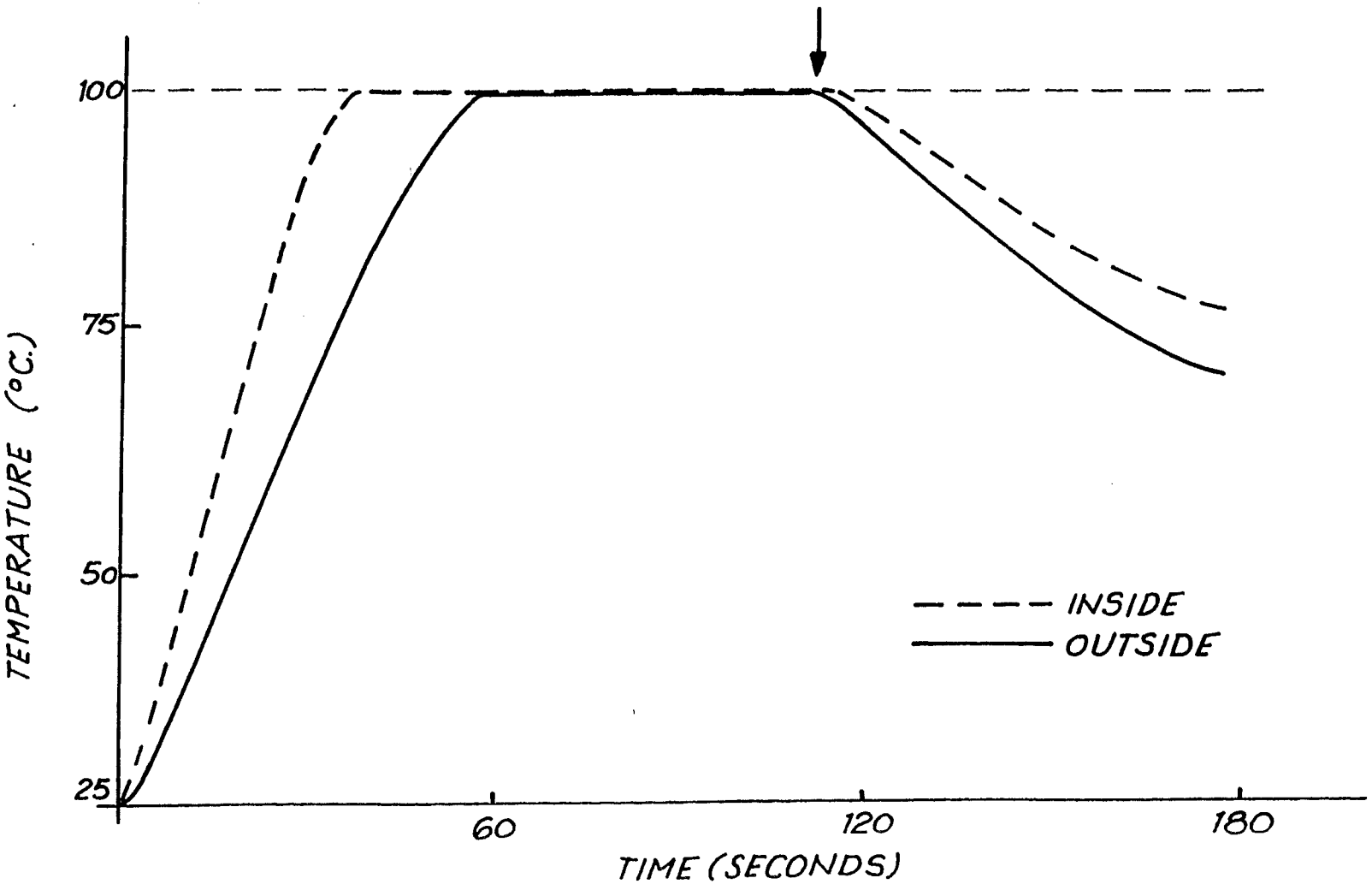

There is also shown in FIG. 4 a graph of the temperatures measured in hair curl near the surface of the former and on the outer surface of the hair curl, when the present invention is used in a permanent setting procedure.

MODES FOR CARRYING OUT THE INVENTION

The apparatus 10 described with reference to FIGS. 1 and 2 comprises a former 13 surrounded over its length by a water absorbent member which is a tubular piece of polystyrene foam 14 enclosed by a water impermeable member which is a clamp 12.

Figure 3:
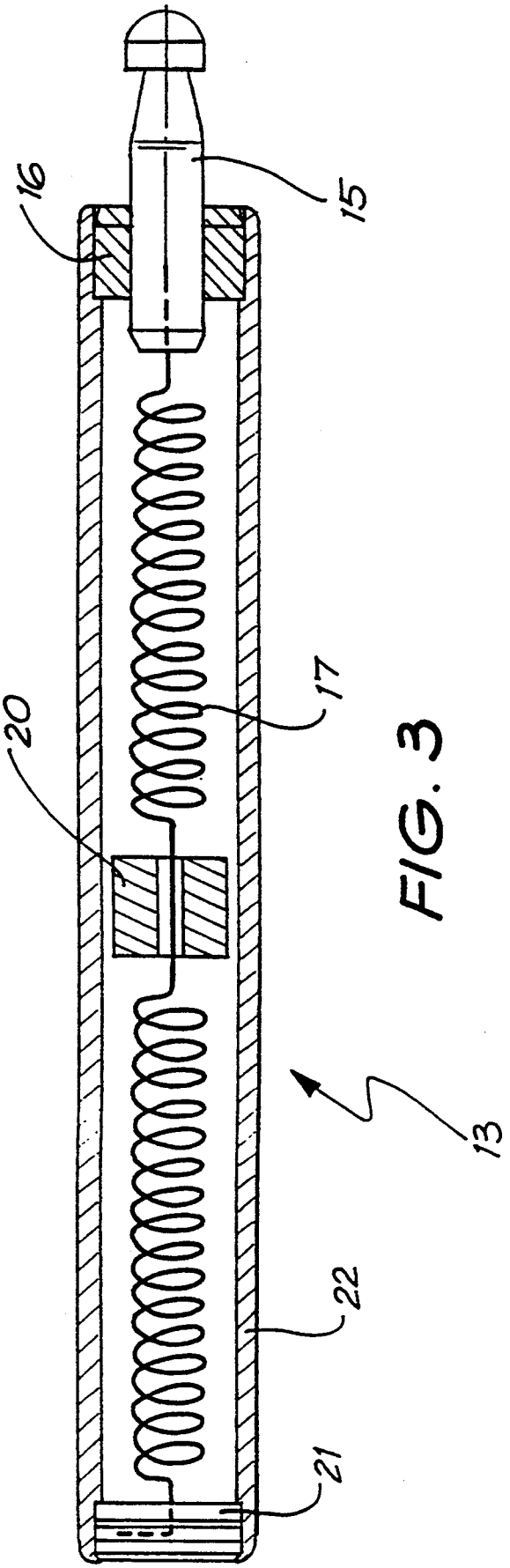
FIG. 3 is a longitudinal sectional view of an infrared source of the invention.

The former 13 comprises a tube 22 formed from 316 stainless steel having a wall thickness of 0.5 mm. As is best seen in FIG. 3, within the former 13 is an infrared source which comprises a spirally wound length of 23 gauge Kanthal 17 which is supported intermediate its length by mica insulator 20.

At one end, the Kanthal is silver soldered into a metallic cap 21 which is crimped onto the tube 22. In this way, electrical contact is established between one end of the Kanthal and the tube 22. At its other end, the Kanthal is connected to a plug 15. The plug 15 is insulated from tube 22 by a teflon plug 16. The plug 15 is adapted to receive an appropriately dimensioned electrical connector so that electrical connection is made between ends of the Kanthal and the voltage source.

The former 13 is surrounded about its length by a tubular piece of polystyrene foam 14, which has a length substantially that of the clamp 12. At the top of the foam 14 is a longitudinally extending slit 19 which is aligned with a longitudinally extending opening 18 in the clamp 12. The foam 14 is dimensioned to fit snugly within the clamp and to contact the former 13 over its length.

Figure 1:
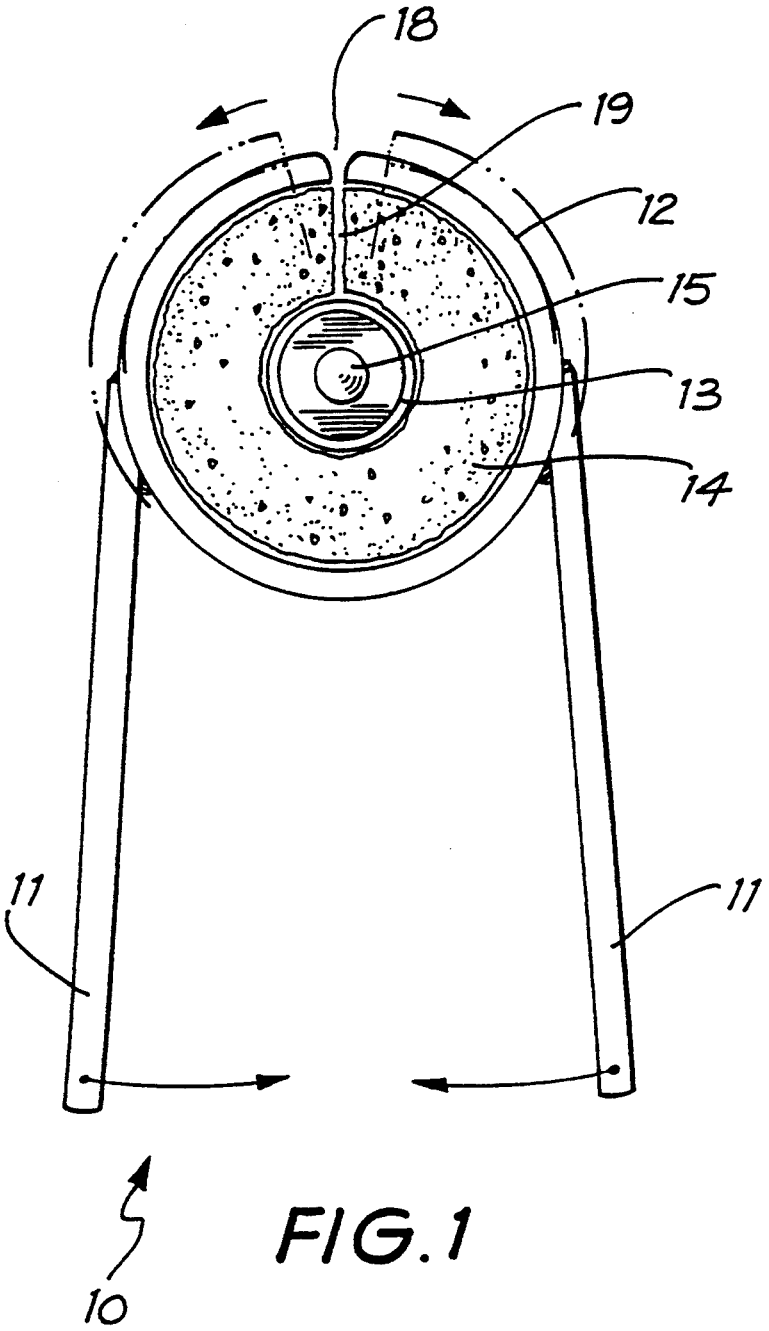
FIG. 1 is an end elevational view.
Figure 2:
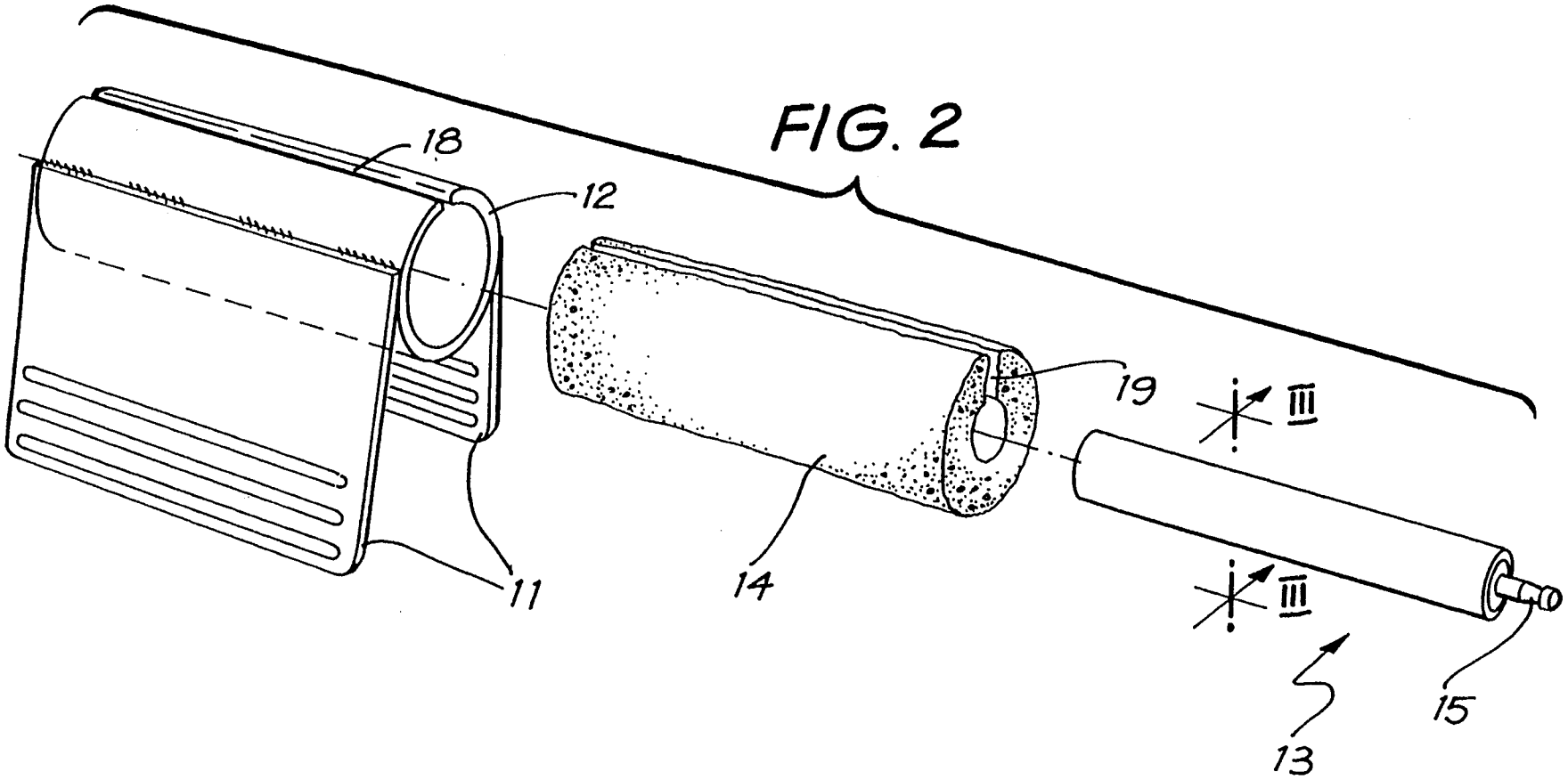
FIG. 2 is an exploded perspective view of the invention.

In order to hold the hair firmly on the former 13, clamp 12 is, as shown in FIG. 1, normally closed. This is achieved in the clamp 12 by having a tubular portion with an opening 18 extending over its full length and a pair of legs 11 each extending downwardly away from opening 18 and from opposing sides of the tubular portion, spaced equally apart from said opening. In this way, a force exerted on the legs 11 in the direction arrowed in FIG. 1 will cause the enlargening of the opening 18, as shown arrowed, and slit 19 to enable the former 13 to be removed.

In use, hair, to which an appropriate amount of perming composition has been added, is wound on the former 13. The clamp 12 is then opened by moving legs 11 in the direction arrowed in FIG. 1 and the former 13 placed in contact with the foam 14 through opening 18 and slit 19. By removing the force from the legs 11, the clamp 12 will close and the hair on the former 13 surrounded by the foam 14 and the tubular portion of the clamp. This process is repeated until half of the hair on the head is ready for setting. The plugs 15 are then placed into appropriate sockets and current applied for an appropriate amount of time, generally about 30–60 seconds.

Desirably, the current supplying the infrared sources is obtained from a high leakage reactance transformer. Additionally, a means to vary the voltage, such as a simple rheostat is included in order to vary the infrared output.

As the amount of the heating time is critical, a timer is used to electrically switch off the power to the infrared sources.

Once the appropriate heating has been completed and the formers allowed to cool, the formers are removed from the clamps and the hair unwound. The other half of the head is then treated as described. On completion, the hair is rinsed with water and then further prepared in the usual manner.

In order to demonstrate the manner in which rapid heating of the hair is achieved, an experiment was conducted where fine wire thermocouples were placed in a hair curl near the surface of a former (inside) and near the outer surface of the curl (outside). The heat input to the infrared source was 15.5 watts with heating commenced at zero time and terminating at about 120 seconds.

The results obtained are shown in FIG. 4, where the point arrowed is the time heating was discontinued. It is evident that the temperature both inside and outside rapidly reached 100° C., a temperature which was maintained then for the duration of heating. Once heating was discontinued, both surfaces of the hair cooled. The rate of cooling could have been enhanced by rinsing with water.

Although this invention has been described with reference to certain preferred embodiments, it will be recognized by persons skilled in the art that numerous variations and modifications are possible without departing from the spirit or scope of the invention as broadly described.

I claim:

1. A permanent hair setting apparatus comprising:

i) a hollow infrared radiation transparent hair former adapted to have hair wound thereon;

ii) an infrared radiation source comprising a hot wire within the hair former, the hot wire being capable of being heated continuously up to a temperature of 1100° C. using a voltage in the range of from 4 to 30 volts;

iii) means to cover the hair wound on the hair former to an extent sufficient to maintain the hair moist during the time in which the infrared source is activated, the means comprising a water impermeable member of sufficient size and shape to substantially cover all the hair being set on the hair former; and iv) a water absorbent member in contact with the means to cover the hair and disposed such that it is between the means and the hair former, but spaced apart from, the hair former by a distance sufficient to allow hair to be wound onto the hair former.

2. An apparatus as in claim 1, wherein the hair former is a vitreous tube formed from materials selected from the group consisting of silica and stainless steel.

3. An apparatus as in claim 2, wherein the water impermeable member comprises a clamp having:

(i) a tubular portion with a longitudinally extending opening adapted to cover the hair former; and (ii) a pair of legs, each on opposing sides of the tubular portion, where the opening is between the legs.

4. An apparatus as in claim 3 wherein the water absorbent member comprises a tubular portion of synthetic plastic foam having a longitudinally extending opening adapted to align with the longitudinally extending opening, in the clamp.

5. An apparatus as in claim 1 including an energizing means for activating the source which is operatively connected to the source.

6. An apparatus as in claim 5 wherein a control means is operatively connected to the energizing means for intermittently activating the infrared source in a predetermined manner.

7. An apparatus as in claim 6 wherein the energizing means comprises a secondary leakage reactance and saturated core transformer.

8. A permanent hair setting apparatus comprising:

i) a hollow infrared radiation absorbent hair former adapted to have hair wound thereon;

ii) an infrared radiation source comprising a hot wire within the hair former, the hot wire being capable of being heated continuously up to a temperature of 1100° C. using a voltage in the range of from 4 to 30 volts;

iii) means to cover the hair wound on the hair former to an extent sufficient to maintain the hair moist during the time in which the infrared source is activated, the means comprising a water impermeable member of sufficient size and shape to substantially cover all the hair being set on the hair former; and (iv) a water absorbent member in contact with the means to cover the hair and disposed such that it is between the means and the hair former, but spaced apart from the hair former by a distance sufficient to allow hair to be wound onto the hair former.

9. An apparatus as in claim 8, wherein the hair former is a vitreous tube formed from materials selected from the group consisting of silica and stainless steel.

10. An apparatus as in claim 8, wherein the water impermeable member comprises a clamp having:

(i) a tubular portion with a longitudinally extending opening adapted to cover the former; and (ii) a pair of legs, each on opposing sides of the tubular portion, where the opening is between the legs.

11. An apparatus as in claim 10 wherein the water absorbent member comprises a tubular portion of synthetic plastic foam having a longitudinally extending opening adapted to align with the longitudinally extending opening in the clamp.

12. An apparatus as in claim 8 including an energizing means for activating the source which is operatively connected to the source.

13. An apparatus as in claim 12 wherein a control means is operatively connected to the energizing means for intermittently activating the infrared source in a predetermined manner.

14. An apparatus as in claim 13 wherein the energizing means comprises a secondary leakage reactance and saturated core transformer.

* * * * *